US009033110B2

(12) United States Patent
Husmann

(10) Patent No.: US 9,033,110 B2
(45) Date of Patent: May 19, 2015

(54) DOUBLE-DECKER ELEVATOR INSTALLATION

(75) Inventor: Josef Husmann, Lucerne (CH)

(73) Assignee: Inventio AG, Hergiswil (CH)

( * ) Notice: Subject to any disclaimer, the term of this patent is extended or adjusted under 35 U.S.C. 154(b) by 539 days.

(21) Appl. No.: 13/314,663

(22) Filed: Dec. 8, 2011

(65) Prior Publication Data

US 2012/0152662 A1 Jun. 21, 2012

(30) Foreign Application Priority Data

Dec. 21, 2010 (EP) ..... 10196218

(51) Int. Cl.
*B66B 11/02* (2006.01)
*B66B 9/00* (2006.01)
*B66B 1/42* (2006.01)

(52) U.S. Cl.
CPC ..... *B66B 1/425* (2013.01); *B66B 11/022* (2013.01)

(58) Field of Classification Search
CPC .... B66B 11/0095; B66B 11/022; B66B 1/425
USPC ..... 187/249, 291
See application file for complete search history.

(56) References Cited

U.S. PATENT DOCUMENTS

| | | | | |
|---|---|---|---|---|
| 2,609,112 | A * | 9/1952 | McKenzie | 414/251 |
| 7,017,714 | B2 * | 3/2006 | Fujita et al. | 187/267 |
| 2012/0097484 | A1 * | 4/2012 | Cortona et al. | 187/249 |

FOREIGN PATENT DOCUMENTS

| | | | | |
|---|---|---|---|---|
| EP | 1074503 | A2 * | 2/2001 | B66B 1/42 |
| JP | 63110468 | U | 7/1988 | |
| JP | 6298472 | A | 10/1994 | |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator installation includes at least one elevator cage carrier in a travel space, a first elevator cage arranged at the elevator cage carrier, a second elevator cage arranged at the elevator carrier and at least one adjusting device for adjustment of the first and second elevator cages relative to the elevator cage carrier. The adjusting device includes at least one first rack connected at least indirectly with the first elevator cage, at least one second rack connected at least directly with the second elevator cage and at least one pinion engaged in the first and second racks. The first and second racks are so arranged with respect to the pinion that rotation of the pinion moves the first and second elevator cages in opposite directions.

17 Claims, 1 Drawing Sheet

| | |
|---|---|
| 2 | CAGE CARRIER |
| 3 | TRAVEL SPACE |
| 4, 5 | STORIES |
| 6, 7 | LONGITUDINAL BEAMS |
| 8, 9, 10 | CROSS BEAMS |
| 11, 12 | ROLLERS |
| 14 | DRIVE PULLEY |
| 15 | DRIVE ENGINE UNIT |
| 20 | ELEVATOR CAGE |
| 21 | ELEVATOR CAGE |
| 28, 29 | PINIONS |
| 34 | ADJUSTING UNIT |
| 40 | DISEMBARKATION LEVEL |
| 50 | DISEMBARKATION LEVEL |
| 51, 53 | FLOOR COVER |
| 52, 54 | ROOF |
| 60.1, 61.1, 60.2, 61.2 | RACK |
| 1 | |
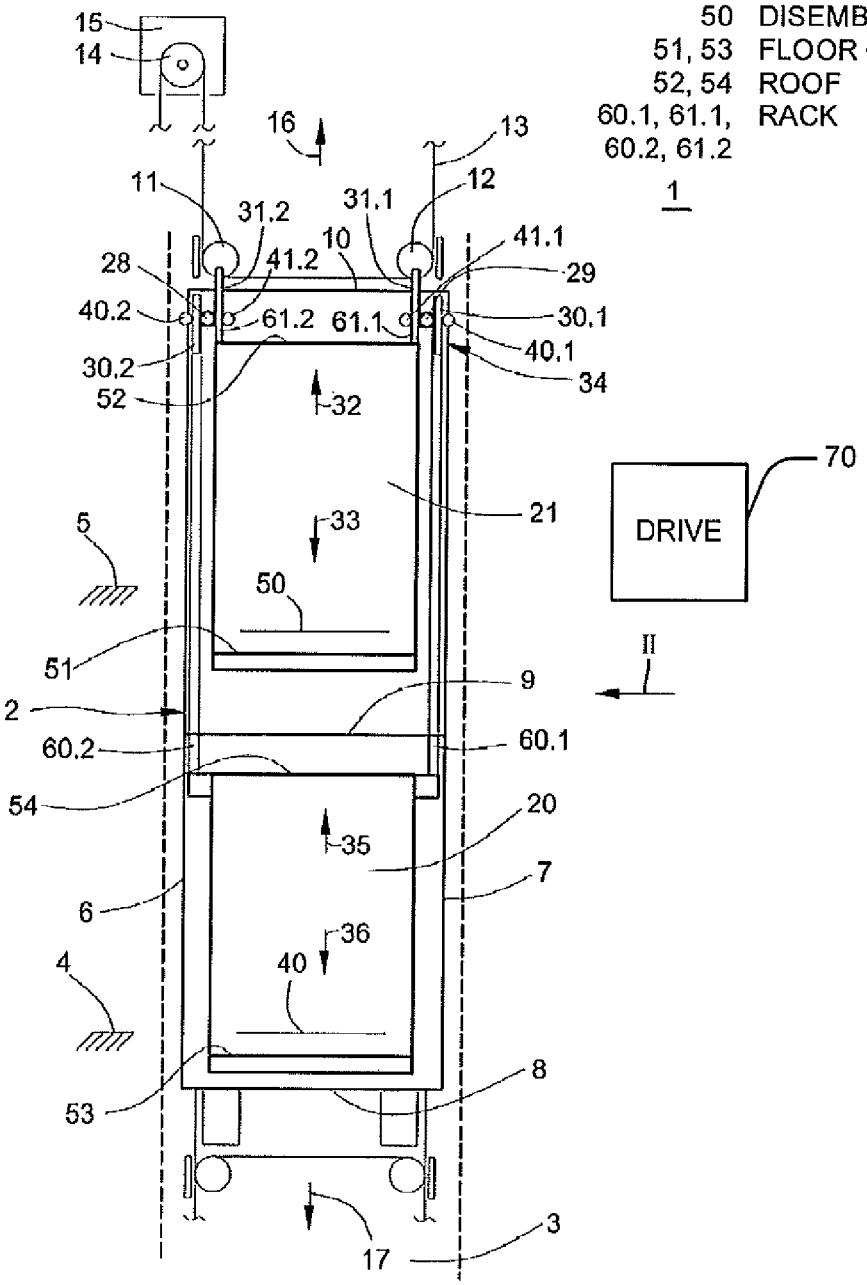

DOUBLE-DECKER ELEVATOR INSTALLATION

CROSS-REFERENCE TO RELATED APPLICATION

This application claims priority to European Patent Application No. 10196218.1, filed Dec. 21, 2010, which is incorporated herein by reference.

FIELD

The disclosure relates to an elevator installation with at least one elevator cage carrier which can receive two or more elevator cages.

BACKGROUND

A double-decker elevator is known from EP 1 074 503 A2. In the known elevator a first elevator cage and a second elevator are arranged vertically one above the other. In addition, a spindle drive is provided which serves for actuation of the two elevator cages. In a case of actuation, the two elevator cages are moved either towards one another or away from one another.

The double-decker elevator known from EP 1 074 503 A2 can result in the spindle drive having a relatively high level of friction, so that an unfavorable level of efficiency for adjustment of the two elevator cages arises. Specifically, this obliges a correspondingly large dimensioning of the drive for adjustment of the two elevator cages. Moreover, the achievable adjustment speed is relatively low. In addition, there is the problem that in operation the spindle is exposed to environmental influences, especially dust, whereby problems with respect to increased friction are exacerbated. This can also require frequent maintenance and lubrication.

SUMMARY

At least some embodiments comprise an elevator installation in which a spacing between the elevator cages arranged at the elevator cage carrier is quickly and reliably settable.

In particular embodiments, an elevator installation comprises at least one elevator cage carrier movable in a travel space provided for travel of the elevator cage carrier, a first elevator cage arranged at the elevator cage carrier, a second elevator cage arranged the elevator cage carrier and at least one adjusting device serving for adjustment of the first and second elevator cages relative to the elevator cage carrier. In that case the adjusting device comprises at least one first rack connected with the first elevator cage at least indirectly, at least one second rack connected with the second elevator cage at least indirectly and at least one pinion engaging in the first and second racks. In this regard, the first and second racks are so arranged with respect to the pinion that a rotation of the pinion sets the first and second elevator cages in motion in opposite directions.

Through the co-operation of a rack and the pinion of the adjusting device a mechanically positive connection is formed. This mechanically positive connection can accept not only tension forces, but also compression forces which act on the first and second elevator cages during braking or acceleration of the elevator cage carrier. A special safety brake or braking device, which serves for safety-braking or braking the first and second elevator cages with respect to the elevator cage carrier, can thereby be eliminated. The adjusting device thus enables, apart from adjustment of the first and second elevator cages relative to the elevator cage carrier, also a more secure fastening of the first and second elevator cages to the elevator cage carrier. Operational safety can thereby be improved.

In the case of simultaneous movement of the first and second elevator cages in opposite direction a high relative speed between the first and second elevator cages can be achieved. The spacing between the first and second elevator cages is thus also settable particularly quickly.

In addition, through the special arrangement of the first and second racks with respect to the pinion a compensation for the weight force of the first and second elevator cages is possible. Thus, only a small drive torque is needed for adjustment of the spacing between the first and second elevator cages. A drive of the pinion can consequently be kept relatively small.

In an embodiment of the elevator installation the elevator cage carrier can be arranged, for example, in an elevator shaft. In this regard, a drive engine unit serving for actuation of the elevator cage carrier can be provided in the elevator shaft. The elevator cage carrier is thereby movable along the provided travel path. In this regard, the elevator cage carrier can be suspended at a traction means. The traction means can in that case be guided in suitable manner over a drive pulley of the drive engine unit. In this regard, such a traction means can have the function, apart from the function of transmission of force or torque of the drive engine unit to the elevator cage carrier in order to actuate the elevator cage carrier, of also supporting the elevator cage carrier. By actuation of the elevator cage carrier there is to be understood, in particular, raising or lowering of the elevator cage carrier. The elevator cage carrier can be guided by one or more guide rails arranged in the elevator shaft.

In further embodiments, the pinion is connected in stationary position with the elevator cage carrier and drivable by a drive. In this regard, the pinion is possibly connected with the elevator cage carrier in the region of a cross beam of the elevator cage carrier. The pinion thus represents a coupling element between the first and second racks and the elevator cage carrier. The first and second elevator cages are therefore coupled to the elevator cage carrier at least by way of the adjusting device.

In additional embodiments, the first rack is connected with the first elevator cage in the region of the roof of the first elevator cage. Correspondingly, the second rack is also connected with the second elevator cage in the region of the roof of the second elevator cage. Consequently, the length of the respective rack can be kept short. Alternatively thereto, the first and second racks are also connectable with the respectively associated elevator cages in the region of the floor.

Possibly, the engagement of the first rack in the pinion takes place in a first direction and the engagement of the second rack in the pinion takes place in a second direction, wherein the first direction is at least approximately opposite to the second direction. The mechanism for conversion into a movement direction of the first and second racks or the first and second elevator cages in opposite sense on rotation of the pinion is thus realized in simple manner.

In some embodiments, at least one cage guide rail, which is connected in stationary position with the elevator cage carrier, is provided in order to guide the first and second elevator cages. In this regard, a movement of the first and second elevator cages relative to the elevator cage is guided.

In further embodiments, the adjusting device comprises a further first rack, a further second rack and a further pinion. In that case the further pinion is connected in stationary position with the elevator cage carrier. Moreover, the further first rack is connected with the first elevator cage at least indirectly and the further second rack is connected with the second elevator cage at least indirectly. In that case the further pinion and the first and second racks can be arranged on a side of the elevator cage carrier diagonally opposite to the pinion. This can enable a balanced suspension of the first and second elevator cages relative to the respective center of gravity. In this embodiment the pinion and the further pinion are possibly driven by a common drive. In that case, for example, a transmission is provided between the drive and pinion and the further pinion. Alternatively thereto the pinion and the further pinion can also be connected with the drive by way of a skewed drive shaft. Fewer drives for driving the pinions are thus needed. In addition, the control of the drives is less complex, since the demands with respect to synchronous rotation of the pinions can be realized more simply.

In some embodiments, a further adjusting device serving for adjustment of the first and second elevator cages relative to the elevator cage carrier is provided. In that case, the further adjusting device is arranged on a side of the elevator cage carrier remote from the adjusting device.

In these further embodiments with two adjusting devices the pinions and the further pinions are possibly driven by a common drive. In that case, for example, in each instance two opposite pinions of the adjusting device and the further adjusting device are operatively connected by means of a common drive shaft. In addition, for example, at least one transmission couples the drive to the drive shafts.

Alternatively thereto, each two opposite pinions of the adjusting device and the further adjusting device are driven by a respective common drive. In this regard, a synchronous operation of the drives can be ensured by a control unit.

Further embodiments constrainedly guide a first and second rack with respect to an associated pinion so that the first and second racks reliably engage in the pinion. A rack is possibly constrainedly guided with respect to the pinion by means of a counter-pressure roller. Alternatively or additionally thereto a rack is guided by means of one or more slide guides at the elevator cage carrier.

BRIEF DESCRIPTION OF THE DRAWINGS

Exemplifying embodiments of the disclosed technologies are explained in more detail in the following description on the basis of the accompanying drawing, in which corresponding elements are provided with corresponding reference numerals and in which:

FIG. 1 shows an exemplary embodiment of an elevator installation in a schematic illustration.

DETAILED DESCRIPTION

FIG. 1 shows an elevator installation 1 with at least one elevator cage carrier 2, which is movable in a travel space 3 provided for travel of the elevator cage carrier 2. In this regard, the travel space 3 can be provided in, for example, an elevator shaft of a building. In that case, several stories 4, 5 are provided, which represent stopping points 4, 5. In that regard, the stories 4, 5 are represented for the sake of illustration, wherein in practice a significantly large number of stories or stopping points can be provided.

The elevator cage carrier 2 comprises longitudinal beams 6, 7 which are connected together by way of cross beams 8, 9, 10. Arranged at the cross beam 10 are rollers 11, 12 around which a traction means 13 is guided. The traction means 13 additionally runs around a drive pulley 14 of a drive engine unit 15. In correspondence with the instantaneous rotational direction of the drive pulley 14 driven by the drive engine unit 15 the elevator cage carrier 2 is moved upwardly in a direction 16 or downwardly in a direction 17 through the travel space 3. The elevator cage carrier 2 can thus move through the travel space 3 in the travel directions 16, 17.

A first elevator cage 20 and a second elevator cage 21 are arranged at the elevator cage carrier 2. In this exemplifying embodiment not only the first elevator cage 20, but also the second elevator cage 21 are suspended relative to the elevator cage carrier 2 by means of an adjusting unit 34.

The adjusting unit 34 comprises at least one first rack 60.1, second rack 61.1 and pinion 29. The first rack 60.1 engages in the pinion 29 from outside and the second rack 61.1 engages in the pinion 29 from inside. In this regard, on the one hand an operative connection between the pinion 29 and the second rack 60.1 and on the other hand an operative connection between the pinion 29 and the second rack 61.1 are formed. Moreover, the first rack 60.1 is connected with the first elevator cage 20 and the second rack 61.1 is connected with the second elevator cage 21. In order to keep the length of the first and second racks 60.1, 61.1 as short as possible, the first and second racks 60.1, 61.1 are connected with the respective elevator cage 20, 21 in the region of the roof 54, 52. Stability and weight advantages relative to a construction with longer racks result therefrom. The first and second racks 60.1, 61.1 possibly have a toothing only in the upper region 61.1 thereof. In that case, the toothing is matched to the stroke height of the first elevator cage 20.

Moreover, a drive 70 is provided which is fastened to the elevator cage carrier, for example in the region of the upper cross beam 10. The drive serves for driving the pinion 29. The drive is typically connected with the rack 29 by way of a drive axle.

A torque of the drive can be converted by way of the co-operation of the pinion 29 with the racks 60.1, 61.1 into an adjusting force in order to adjust the first and second elevator cages 20, 21 relative to the elevator cage carrier 2. In that case the first and second elevator cages 20, 21 are adjustable in opposite adjustment directions 32, 36 or 33, 35 depending on the respective rotational sense of the pinion 29.

The adjusting device 34 thus enables a raising 35 and lowering 36 of the first elevator cage 20 and a raising 32 and lowering 33 of the second elevator cage 21 in opposite directions relative to the elevator cage carrier 2. A spacing between the elevator cages 20, 21 can thereby be varied within certain limits. Thus, a positioning of the two elevator cages 20, 21 with respect to the stories 4, 5 can be carried out in advantageous manner.

Thus, for moving up to the stories 4, 5 the spacing between the first and second elevator cages 20, 21 can be set so that this corresponds with the spacing between adjacent stories 4, 5. The elevator cage frame 2 with the two elevator cages 20, 21 is moved by means of the drive engine unit 15 to the level of the stopping point of the story 4, 5. In that case a disembarkation level 40 of the first elevator cage 20, which is defined by a floor cover 53 of the first elevator cage 20, and a disembarkation level 50 of the second elevator cage 21, which is defined by a floor cover 51 of the second elevator cage 21, are brought at least approximately into coincidence with the level of the stopping point 4 and the level of the stopping point 5. In this regard, a positioning of the first and second elevator cages 20, 21 relative to the elevator cage carrier 2 can be carried out already before reaching the stopping point 4, 5.

Thus, compensation can be provided for differences, which exist within the building, in the story spacings. For example, a story spacing can vary within the building, since in part false floors for accommodating ventilating or air-conditioning equipment are provided. A further example is a different story height. For example, a reception with a larger room height can be provided in a ground floor.

During adjustment of the first and second elevator cages 20, 21 relative to the elevator cage carrier 2 and also in a case of fixing of the first and second elevator cages 21 relative to the elevator cage carrier 2 a mechanically positive couple between the pinion 29 and, respectively, the first and second racks 60.1, 61.1 can often be guaranteed. Thus, for example, in the case of initiation of an emergency stop a reliable fixing of the first and second elevator cages 20, 21 to the elevator cage carrier 2 can be guaranteed. Separate equipment, particularly a braking device and safety brake, can therefore be eliminated.

In the illustrated example the adjusting device 34 comprises a further pinion 28 which is connected with the elevator cage frame 2 on a side of the elevator cages 20, 21 which is opposite with respect to the pinion 29. Here, too, the pinion 28 is possibly arranged in the region of the upper cross beam 10. Moreover, a further first rack 60.2 and a further second rack 61.2 are provided. The further first rack 60.2 is similarly connected with the first elevator cage 20 and engages from outside in the second pinion 28. The further second rack 61.2 is connected with the second elevator cage 21 and engages in the further pinion from inside. Here, too, the further first and second racks 60.2, 61.2 are toothed only in an upper region 30.2, 31.2.

The pinion 29 and the further pinion 28 are possibly drivable by a common drive. Typically, the pinion 29 and the further pinion 28 are connected with the common drive by way of a transmission.

In a further form of embodiment of an adjusting unit 34 with two pinions 29, 28 the pinion 29 is arranged on the front side of the elevator cage frame 2 and the further pinion 28 on the rear side of the elevator cage frame 2. The further pinion 28 is thus attached to the elevator cage frame 2 diagonally opposite with respect to the pinion 29. In that case, the pinion 29 and the further pinion 28 are coupled to the common drive by means of a similarly diagonally oriented drive shaft. A coupling by way of a transmission is equally usable here.

In a further form of embodiment, in addition to the adjusting device 34 a further adjusting device is provided. The further adjusting device similarly has two pinions and two racks which engage in the respective pinion. The arrangement as well as the functioning of the pinions and racks of the further adjusting device can be identical to those of the adjusting device 34. In that case, the pinions and the racks of the further adjusting device are arranged on a side of the elevator cage frame remote from the adjusting device 34. The pinions 29 as well as the further pinions 28 are possibly drivable by means of a common drive. In that regard, a drive shaft connects a first pair of aligned pinions 29 and a second pair of aligned further pinions 28. The common drive drives the drive shafts by means of at least one transmission.

Moreover, a pair of cage guide rails for guidance of the first and second elevator cages 20, 21 in the elevator cage frame 2 is provided. The cage guide rails are fastened to the elevator cage frame 2, possibly each to a respective longitudinal beam 6, 7. In this case, the first and second elevator cages 20, 21 can be reliably guided in the elevator cage frame 2 during adjusting movement.

The respective racks 60.1, 61.1, 60.2, 61.2 are possibly constrainedly guided. The constrained guidance is such that the racks 60.1, 61.1, 60.2, 61.2 run at a predetermined spacing past the associated pinions 29, 28 and always engage in the associated pinion 29, 28. A reliable operative connection is thereby created. In at least some cases, a mechanically positive connection is always ensured, since slipping of the racks 60.1, 61, 61.1, 61.2 out of the pinions 29, 28 is reliably prevented. A high level of operating safety is, in at least some cases, thereby guaranteed.

The constrained guides are, for example, realizable as counter-pressure rollers 40.1, 41.1, 40.2, 41.2 or as a sliding guide. In that case, possibly at least one constrained guide per rack 60.1, 61.1, 60.2, 61.2 is provided.

A counter-pressure roller 40.1, 41.1, 40.2, 41.2 is fastened to the elevator cage frame 2 at substantially the same level as an associated pinion 29, 28. Moreover, each counter-pressure roller 40.1, 41.1, 40.2, 41.2 runs on the rear side of an associated rack 60.1, 61.1, 60.2, 61.2, i.e. on the side of a rack remote from the toothing 30.1, 31.1, 30.2, 31.2. In this regard, the counter-pressure roller 40.1, 41.1, 40.2, 41.2 acts on the associated rack 60.1, 61.1, 60.2, 61.2 in a direction which is opposite to a direction in which the associated pinion 29, 98 engages in the rack 60.1, 61.1, 60.2, 61.2. The mechanically positive connection between the pinion 28 and the rack 61 is, in at least some cases, thereby guaranteed even in a case of occurrence of transverse forces or the like. A high level of operational safety is, in at least some cases, thereby achieved.

Alternatively or in addition to the counter-pressure roller a sliding guide per rack 60.1, 61.1, 60.2, 61.2 can be provided. The sliding guide comprises one or more sliding guide elements which are fastened to the elevator cage 2 along the course of a rack 60.1, 61.1, 60.2, 61.2. A sliding guide is possibly designed as a slide shore, as a guide bush or the like.

Since the design of the elevator cage carrier 2 with the elevator cages 20, 21 requires relatively few components, the overall mass is relatively low. Moreover, a high level of efficiency in the co-operation of a pinion with a rack can be achieved, so that an advantageous dimensioning of a drive is possible. Moreover, a high adjusting speed can be realized. A further advantage consists in that the adjusting is connected with a low output of noise and thus is very quiet. Specifically, an adjustment can also be achieved with a relatively small drive. In this regard, the drive can comprise, apart from an electric motor, also a transmission. The drive is then designed as a transmission/drive unit.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator installation, comprising:

an elevator cage carrier in a travel space;

a first elevator cage arranged at the elevator cage carrier;

a second elevator cage arranged at the elevator cage carrier; and an adjusting device, the adjusting device comprising a first rack connected with the first elevator cage, a second rack connected with the second elevator cage, and a pinion engaged in the first and second racks, the first and second racks being configured to move the first and second elevator cages in opposite directions in response to a rotation of the pinion.

2. The elevator installation of claim 1, the pinion being fixed relative to the elevator cage carrier and coupled to a drive.

3. The elevator installation of claim 2, the pinion being connected with the elevator cage near a cross beam.

4. The elevator installation of claim 1, the first and second elevator cages being coupled to the elevator cage carrier by the adjusting device.

5. The elevator installation of claim 1, the first rack being connected with the first elevator cage in a roof region of the first elevator cage and the second rack being connected with the second elevator cage in a roof region of the second elevator cage.

6. The elevator installation of claim 1, the pinion being engaged in the first rack in a first direction and the pinion being engaged in the second rack in a second direction, the first and second directions being opposite each other or approximately opposite each other.

7. The elevator installation of claim 1, further comprising a cage guide rail, the cage guide rail being connected to the elevator cage carrier, the first and second elevator cages being guided at the cage guide rail.

8. The elevator installation of claim 1, the pinion being a first pinion, the adjusting device further comprising:

a third rack;

a fourth rack; and a second pinion, the second pinion being fixed relative to the elevator cage carrier, the third rack being connected to the first elevator cage and the second rack being connected to the second elevator cage.

9. The elevator installation of claim 8, the first and second pinions being connected to a common drive.

10. The elevator installation of claim 8, the second pinion, the third rack and the fourth rack being arranged on a side of the elevator cage carrier diagonally opposite to the first pinion.

11. The elevator installation of claim 1, the adjusting device being a first adjusting device, the elevator installation further comprising a second adjusting device, the second adjusting device being arranged on a side of the elevator cage carrier opposite to the first adjusting device.

12. The elevator installation of claim 11, the first and second adjusting devices being connected to a common drive.

13. The elevator installation of claim 12, the first and second adjusting devices being connected to a further common drive.

14. The elevator installation of claim 1, the first rack and the second rack being constrainedly guided with respect to the pinion.

15. The elevator installation of claim 14, the first rack and the second rack being constrainedly guided by respective counter-pressure rollers.

16. The elevator installation of claim 15, the respective counter-pressure rollers being attached to the elevator cage carrier at substantially the same level as the pinion.

17. An elevator installation, comprising:

an elevator cage carrier in a travel space;

a first elevator cage arranged at the elevator cage carrier;

a second elevator cage arranged at the elevator cage carrier;

an adjusting device, the adjusting device comprising a first rack connected with the first elevator cage, a second rack connected with the second elevator cage, and a first pinion engaged in the first and second racks, the first and second racks being configured to move the first and second elevator cages in opposite directions in response to a rotation of the first pinion;

a further adjusting device comprising a third rack connected with the first elevator cage, a fourth rack connected with the second elevator cage, and a second pinion engaged in the third and fourth racks, the third and fourth racks being configured to move the first and second elevator cages in opposite directions in response to a rotation of the second pinion; and the first and second pinions being connected to a common drive for rotation.

* * * * *